United States Patent [19]

Ikegawa et al.

[11] 4,441,870

[45] Apr. 10, 1984

[54] SCROLL MEMBER

[75] Inventors: Masato Ikegawa; Eiji Sato, both of Ibaraki; Kenji Tojo, Shimizu, all of Japan

[73] Assignee: Hitachi, Ltd., Tokyo, Japan

[21] Appl. No.: 314,395

[22] Filed: Oct. 23, 1981

[30] Foreign Application Priority Data

Oct. 27, 1980 [JP] Japan ..... 55-149401

[51] Int. Cl.[3] ..... F01C 1/02

[52] U.S. Cl. ..... 418/55; 418/150

[58] Field of Search ..... 418/55, 150; 29/156.4 R

[56] References Cited

U.S. PATENT DOCUMENTS 3,884,599 5/1975 Young et al. ..... 418/55

4,192,152 3/1980 Armstrong et al. ..... 418/55

*Primary Examiner*—John J. Vrablik

*Attorney, Agent, or Firm*—Antonelli, Terry & Wands

[57] ABSTRACT

A scroll member including a wrap having its thickness boundaries defined by an outer side wall surface and an inner side wall surface, wherein the inner side wall surface of the wrap includes a starting end portion formed to coincide with an arc of a circle having a predetermined radius.

6 Claims, 4 Drawing Figures

SCROLL MEMBER

BACKGROUND OF THE INVENTION

This invention relates to a scroll member used with a scroll type liquid pump, a scroll type compressor, a scroll type expander, etc.

The principle of operation of a scroll type pump, compressor or expander is described in, for example, U.S. Pat. No. 801,182.

A scroll type fluid apparatus comprises two scroll members each including an end plate and a wrap of the vortical form located in an upstanding position on the surface of the wrap, with the two scroll members being arranged in combination in such a manner that the end plates face each other at their surfaces and the wraps are in meshing engagement with each other so that one of the scroll members moves in orbiting movement while being prevented from rotating on its own axis with respect to the other scroll member. Thus, the pockets defined between the two scroll members have their volumes varied as one scroll member moves in orbiting movement while the other scroll member remains stationary.

The curve constituting the wrap of each scroll member is in the majority of its length an involute curve of a circle. Such curve is shown, for example in U.S. Pat. Nos. 801,182, 3,600,114, 3,817,664, and 3,994,635. There is nowhere in the prior art documents, however, any description of the shape of the starting end portion of the wrap.

Additionally U.S. Pat. No. 3,994,635 discloses a method of producing a scroll member wherein an end plate and a wrap are made separately and the wrap is fitted into a shallow groove formed in the end plate. It is also disclosed therein that milling is relied on for forming the shallow groove on the end plate. It will be understood from this that the scroll member can be produced by milling. However, there is no express mention in this prior art document of a method for forming the scroll member in a concrete manner.

SUMMARY OF THE INVENTION

An object of this invention is to provide a scroll member in which the scroll member has a small diameter as compared with other scroll members for obtaining a predetermined amount of delivery.

Another object is to provide a method of producing a scroll member by milling which is described in detail.

Still another object is to provide a scroll member which has a diameter smaller than other scroll members for obtaining a predetermined volume ratio.

Still another object is to provide a method of producing a scroll member capable of machining the side surfaces of the wrap with a high degree of efficiency.

A still another object is to provide a method of producing a scroll member capable of forming the end plate of the scroll member in such a manner that its bottom surface is flat.

A further object is to provide a scroll member in which the flow of a fluid oriented toward a center port can be made smooth, to thereby minimize a flow loss.

The aforesaid objects of the invention can be accomplished by rendering the starting portion of the inner side surface curve of the wrap of the scroll member an arcuate form of a predetermined radius, and carrying out machining of the inner side surface and the outer side surface of the wrap simultaneously by means of an end milling cutter adapted to contact both the inner side surface and the outer side surface of the wrap at a time.

DESCRIPTION OF THE PREFERRED EMBODIMENT

Figure 1:
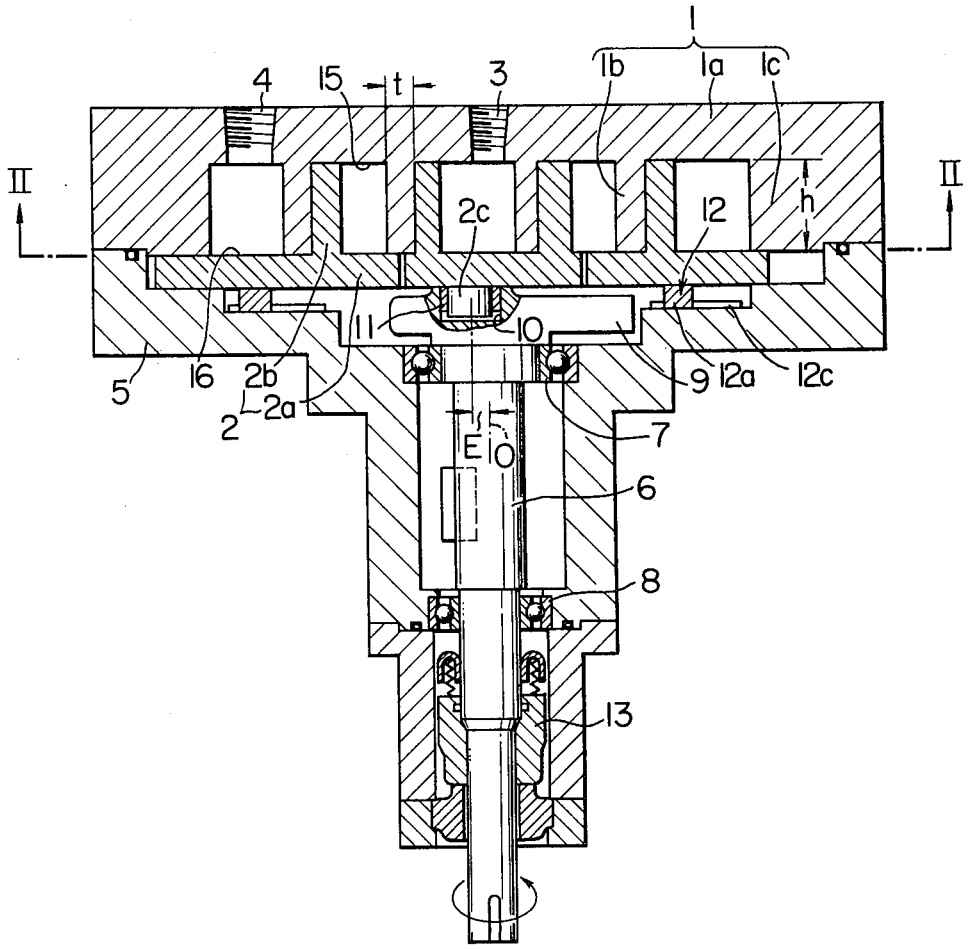
FIG. 1 is a vertical cross-sectional view of a scroll fluid apparatus in which the scroll member according to this invention is used.
Figure 2:
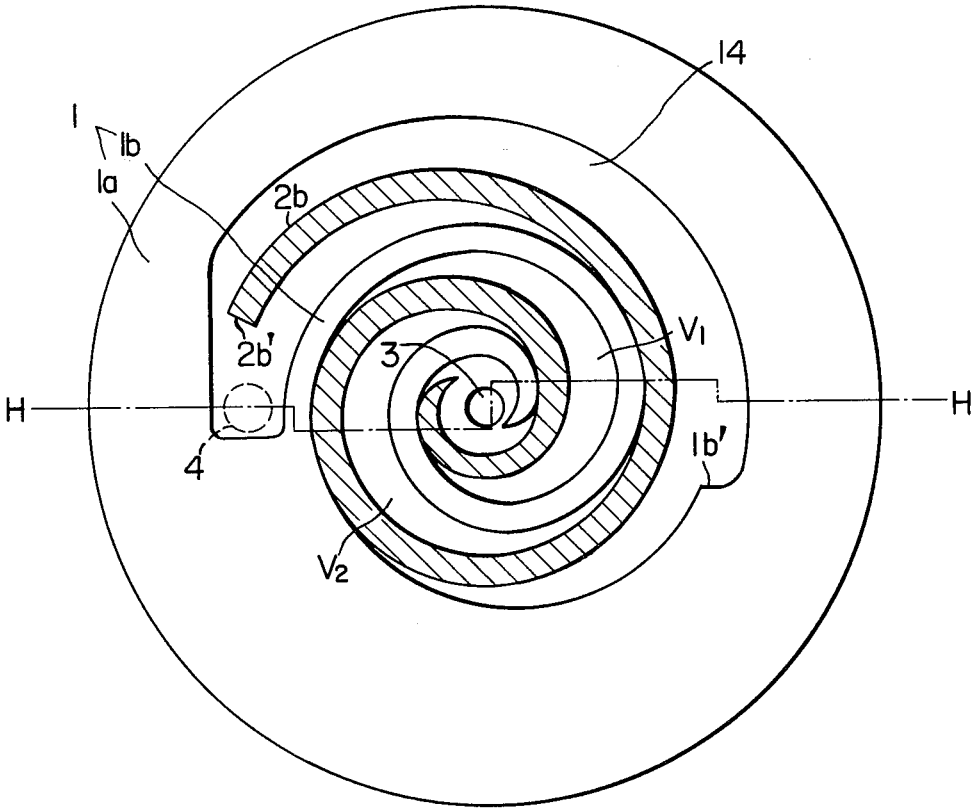
FIG. 2 is a cross-sectional view taken along the line II—II in FIG. 1.

Referring now to FIGS. 1 and 2, according to these figures, stationary scroll member 1 includes an end plate 1*a* of the disc shape, a wrap 1*b* located in an upstanding position on the surface of the wrap 1*a*, and an annular portion 1*c*. An orbiting scroll member 2 includes an end plate 2*a* of the disc shape, and a wrap 2*b* located in an upstanding position on the surface of the end plate 2*a*. The wraps 1*b* and 2*b* of the two scroll members 1 and 2 are each in the form of an involute curve (which is the involute of a circle) or a curve similar thereto in the majority of portion thereof, and have a thickness t and a height h. The starting end portions of the two wraps 1*b* and 2*b* are each arcuate in shape on the inner side surface thereof. A port 3 is located near the center of the end plate 1*a* of the stationary scroll member 1, and another port 4 is located in an outer peripheral portion thereof. The port 3 serves as a discharge port when the apparatus functions as a compressor and as a suction port when it functions as an expander. The port 4 serves as a suction port when the apparatus functions as a compressor and as a discharge port when it functions as an expander.

Projecting outwardly from the undersurface of the end plate 2*a* of the orbiting scroll member 2 opposite the surface thereof on which the wrap 2*b* is located is a scroll pin 2*c* having a center axis coinciding with the center of the end plate 2*a*. The scroll pin 2*c* may be replaced by a recess of the same diameter as the scroll pin 2*c* formed on the end plate 2*a*.

The two scroll members 1 and 2 are arranged in combination such that the surfaces of the end plates 1*a* and 2*a* on which the wraps 1*b* and 2*b* are located face each other and the wraps 1*b* and 2*b* are in meshing engagement with each other with terminating end portions 1*b*′ and 2*b*′ of the wraps 1*b* and 2*b* being displaced for a circumferential extent of 180 degrees.

A frame 5 is bolted to the annular portion 1*c* of the stationary scroll member 1 in several positions. A crank shaft 6, which is journaled by two sets of bearings 7 and 8 secured to the frame 5, has a center axis O coinciding with the center of the stationary scroll member 1. The crank shaft 6 has a balance weight 9 formed as a unit therewith. However, the balance weight 9 may be a separate entity independent of the crank shaft 6. The crank shaft 6 is formed at its head with a hollow boss 10 which is centered at a position off center by a distance E from the center axis O of the crank shaft 6, for receiving the scroll pin 2*c* therein. A needle bearing 11 is interposed between the hollow boss 10 and the scroll pin 2*c*. Instead, the pin 2*c* may be attached to the head of the crank shaft 6 and the hollow boss 10 may be formed at the end plate 2a of the orbiting scroll member 2.

A rotation on-its-own-axis preventing member 12, intended to prevent the rotation of the orbiting scroll member 2 on its own axis relative to the stationary scroll member 1, is interposed between the undersurface of the end plate 2a of the orbiting scroll member 2 and the frame 5. The rotation preventing member 12 includes a ring 12a, and at least two sets of keys 12b and 12c. The ring 12a has keyways on each of its end surfaces, with the keyways on one end surface crossing the keyways on the other end surface at a right angle. The key 12b is connected to the frame 5, and the key 12c is connected to the end plate 2a. A mechanical seal 13 is mounted in a portion where the crank shaft 6 penetrates the frame 5 and extends outwardly thereof.

In the apparatus shown, a main body thereof is exposed to the atmosphere or the apparatus is what is referred to as an open type apparatus. The apparatus can be formed, however, as a closed type apparatus in which a drive motor (not shown) is connected to the crank shaft 6 and the apparatus as a whole is enclosed by a casing (not shown).

Operation of the apparatus shown in FIGS. 1 and 2 will be described.

Upon the crank shaft 6 being driven by a prime mover, not shown, to rotate in the direction of an arrow in FIG. 1 (the direction is clockwise in FIG. 2), the orbiting scroll member 2 moves in orbiting movement without changing its posture with regard to the stationary scroll member 1 (or without rotating on its own axis apparently). The sealed spaces $V_1$ and $V_2$, defined between the two scroll members 1 and 2, have their volumes reduced while rotating in the same direction as the orbiting movement of the orbiting scroll member 2. As a result, gas introduced into the sealed spaces $V_1$ and $V_2$ is compressed and exhausted through the port 3.

As the crank shaft 6 rotates in a direction opposite to the direction of the arrow, the sealed spaces $V_1$ and $V_2$ have their volumes increased. Introduction of a high temperature and pressure gas through the port 3 into the sealed spaces $V_1$ and $V_2$ results in the gas being expanded therein, to generate a motive force for rotation. The apparatus acts as a liquid pump if the wraps 1b and 2b are wound one and a half turns so that the fluid will be exhausted as soon as the sealed spaces are formed.

Figure 3:
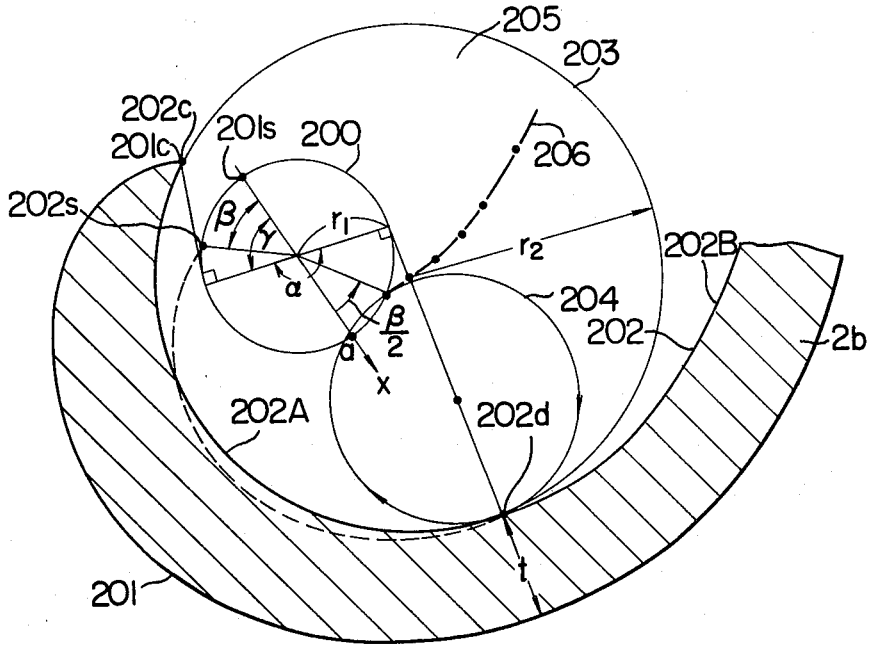
FIG. 3 is a cross-sectional view, on an enlarged scale, of the starting end portion of a scroll member.

The starting end portion of a wrap is of the same shape in the two scroll members 1 and 2, consequently, the following description in connection with FIG. 3 describes the starting end portion of the wrap 2b of the orbiting scroll member 2. The boundaries of the thickness of the wrap 2b are defined by two side wall surfaces 201 and 202. The side wall surface 201, defining an outer-side boundary, is constituted by a curve coincident with the involute of a circle 200, called a base circle. The side wall surface 202, defining an inner-side boundary, is constituted by a curve coincident with two curves 202A, namely, a curve between a point 202c and a point 202d, and a curve 202B. The curve 202A is an arc corresponding to a portion of a circle 203 of a radius $r_2$, and the curve 202B is an involute corresponding to the involute of the base circle 200.

The arcuate portion 202A has an extension range $\alpha$ which is $\pi$ radians at an involute angle using the forward end of the wrap 2b as a reference. A point 202d, at which the arcuate portion 202A terminates, is disposed at a position at which the starting end of the wrap of the opposite member (or the wrap 1b) is brought into contact with or comes closest to the wrap 2b.

Most advantageously the extension range $\alpha$ of the arcuate portion 202A (which is represented by an involute angle) is $\pi$ radians. The extension range $\alpha$ is allowed to be less than $\pi$ radians. When the extension range $\alpha$ is greater than $\pi$ radians, one might consider that there would be some trouble. However, this is not always the case. The situation can be accounted for by the following observations. When the extension range is slightly larger or, for example, 10% larger than $\pi$ radians, the gap between the side wall surface of the wrap of the opposite number (the wrap 1b) and the side wall surface of the wrap 2 would increase within the range in which $\alpha$ is greater than $\pi$, so that fluid leaks might increase. However, when such condition is created, the sealed space closest to the port 3 would have already communicated with the port 3 or would be immediately before being brought into communication therewith, so that no seal would need be provided between the sealed space and the port 3. Thus, no trouble would be caused by an increase in the fluid leaks through this gap to occur. Thus, even if the extension range $\alpha$ is greater than $\pi$ radians, the apparatus can be put to practical use if the angle is about 1.1 $\pi$ radians.

The circle 203 has a diameter which corresponds to the outer diameter of an end milling cutter 205 used for machining the wrap 2b. The diameter of the circle 203 or the outer diameter of the end milling cutter 205 has a value enough to enable it to come into contact with both the side wall surface 201 that defines the outer-side boundary of the wrap 2b and the side wall surface 202B that defines the inner-side boundary opposed to the side wall surface 201. This state will be easily understood by referring to the stationary scroll member of FIG. 4.

When the radius $r_1$ of the base circle 200 shows a change in value, it is indicated as a change in the involute change per involute angle. The greater the radius $r_1$, the closer would be the involute to a tangent to the base circle 200; the smaller the radius $r_1$, the closer would be the involute to the base circle 200.

If the difference $\beta$ radians in involute angle between a starting point 201s on the base circle of the involute line constituting the outer side wall surface 201 and a starting point 202s on the base circle of the involute line constituting the inner side wall surface 202B is caused to change, then the radial thickness t of the wrap 2b shows a change which is proportional to the value of $\beta$. The greater the value of $\beta$, the greater the thickness t in proportion to the increase in $\beta$; the smaller the value of $\beta$, the smaller the thickness t in proportion to the decrease in $\beta$.

Figure 4:
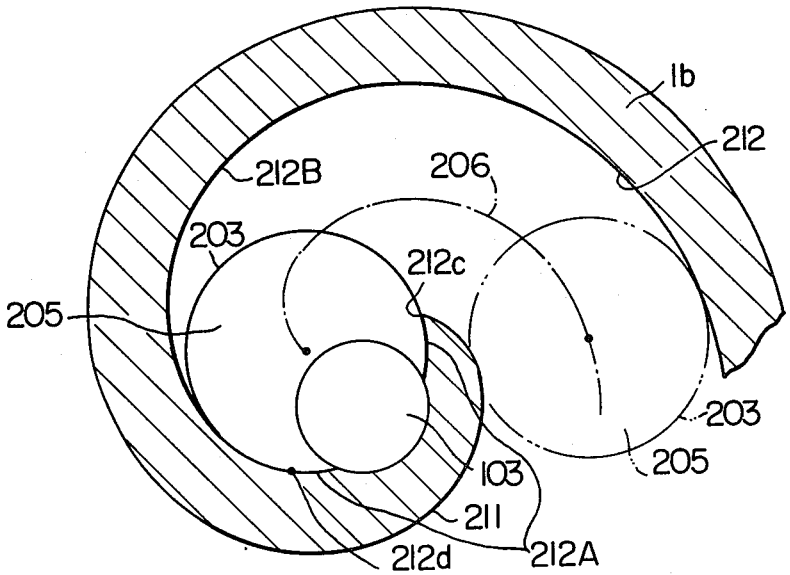
FIG. 4 is a cross-sectional view, on an enlarged scale, of a modification of the scroll member shown in FIG. 3.

FIG. 4 shows a modification of the scroll member shown in FIG. 3. An outer side curve 211 and an inner side curve 212 corresponding to opposite wall surfaces defining the boundaries of the thickness of the wrap 1b are the same as the side wall surfaces 201 and 202 described in FIG. 3. The only distinction is that the port 103 is provided in a position partially overlapping an arcuate portion 212A of the inner side wall surface 212 of the wrap 1b.

Milling machining of a scroll member with an end milling cutter will now be described by referring to FIGS. 2–4. In milling machines, a desired curve is described by moving a table for supporting material to be worked and a cutter in combination. However, in the description presently to be set forth, the operation will be described as being performed by moving the cutter alone. The material to be milled may be one which is worked beforehand into a shape close to the wrap in its finished form or may be disc-shaped and have no parts to be shaped.

For working the material beforehand into a shape close to the wrap 1*b* in its finished form, any known means, such as precision casting, forging, powder compacting, spark erosion machining or electrolytic working. However, in the present invention, what is to be used as material is not so important as to require a description herein. The end milling cutter 205 selected has an outer diameter which is of a value such that the cutter 205 is brought into contact with both the outer side curve 201 (211) and the inner side curve 202B (212B) of the wraps 1*b* (and 2*b*), respectively, (see FIG. 4).

In subjecting the stationary scroll member 1 to milling machining, the cutter 205 is set in a position which is greater in winding angle by $\pi$ (rad) than the terminating end 1*b*'. The center of the cutter 205 is set in a position disposed outside the final outer side wall surface of the wrap 1*b* by a distance corresponding to the radius of the cutter 205. From this position, the cutter 205 is fed toward the material for a distance corresponding to the height h of the wrap 1*b*, and then moved along a curve 206 parallel to the side wall surfaces 211 and 212B toward the starting end portion. Only the outer side wall surface 211 of the wrap 1*b* is machined. The range in which only the outer wall surface 211 of the wrap 1*b* is machined is about $\pi$ (rad) up to the terminating end 1*b*'. Thereafter the inner side wall surface 212B and the outer side wall surface 211 of the wrap 1*b* are simultaneously machined. When the cutter 205 reaches a position in which it coincides with the circle 203 (solid line) as shown in FIG. 4, milling machining of the wrap 1*b* portion is finished. Additionally the stationary scroll member 1 is formed with a relief 14 (FIG. 2) extending from the terminating end 1*b*' of the wrap 1*b* substantially for an extent of $\pi$ (rad). The relief 14 is formed before or after the wrap 1*b* is formed. In the description set forth hereinabove, the relief 14 has been described as being formed before the wrap 1*b* is formed.

In the case of the orbiting scroll member 2, the cutter 205 is positioned in such a manner that its center is set at a position in which the outer periphery of the cutter 205 is brought into contact with the outer side wall surface 201 of the wrap 2*b* at its terminating end portion 2*b*' or in a position in which the center of the cutter 205 is displaced outwardly by a distance corresponding to the radius thereof from the outer side wall surface 201 to which a final shape has been given by milling. After the cutter 205 is positioned as aforesaid, it is first fed toward the material for a distance corresponding to the height of the wrap 2*b* (which is equal to the height h of the wrap 1*b*) and then moved toward the starting end portion of the wrap 2*b* along a curve 206 parallel to the two side wall surfaces 201 and 202B. By this operation, the outer side wall surface 201 alone is first machined, the machining of the outer side wall surface 201 alone being continued for 2 $\pi$ radians. Thereafter the inner side wall surface 202B of the wrap 2*b* is simultaneously machined along with the outer side wall surface 201. When the cutter 205 has reached a position shown in FIG. 3 in which it coincides with the circle 203, machining of the wrap 2*b* is finished. It is to be understood that the same scroll member as the scroll member described above can be formed by setting the cutter 205 at the starting end of the wrap (the position which is coincident with the circle 203) and moving it toward the terminating end along the involute 206, in the same manner as described hereinabove. The cutter 205 used in the invention is shaped such that it is in contact with both the inner and outer side wall surfaces of the wrap to which a final shape has been given, so that it is possible to simultaneously form both the inner and outer side wall surfaces that define the inner-side and outer-side boundaries of the thickness of the wrap. The method of forming a scroll member such as the one described hereinabove is novel, practical and efficient.

Another feature of this wrap forming method is that, since the method allows a bottom wall surface 15 or 16 (as shown in FIG. 1) to be formed simultaneously as the two side wall surfaces of a wrap are formed, it is possible to obtain a smooth flatness on a bottom surface. Assume that each of the two side wall surfaces of a wrap is machined separately. Difficulties would be experienced in setting the depth of the cutter for performing a second machining operation in such a manner that the bottom surface to be formed by the second machining operation would completely coincide with the bottom surface that has been obtained in a first machining operation. Stated differently, differences in height, although slight in degree, would surely be produced between the bottom surface machined in the first operation and the bottom surface machined in the second operation. The present invention is capable of eliminating this problem.

The scroll members 1, 2 according to the invention are shaped such that the inner side wall surfaces of the starting end portions of the wraps 1*b* and 2*b* are arcuate, so that there is no danger of the two scroll members interfering with the movement to each other. This makes it possible to use at least two of the scroll members in combination. When this is the case, the forward end 212C of the wrap 1*b* becomes closest to (or comes into point contact with) the wrap 2*b* of the orbiting scroll member 2 at the point 202*d*, and the path of movement of the forward end 212*c* of the wrap 1*b* during the orbiting movement describes a circle 204 in contact with the point 202*d*. Since the arcuate portion 202A of the wrap 2*b* is disposed outside the locus (circle 204) of the forward end of the wrap 1*b*, the arcuate portion of the wrap 2*b* is free from the danger of interfering with the movement of the forward end of the wrap 1*b* during operation.

In the scroll member according to the invention, the involute angle $\gamma$ at the starting point 201*c* (corresponding to the point 202*c*) of the wrap 1*b*, (2*b*) can be minimized because the involute angle $\gamma$ can be made minimum in forming the end 201*c* of the outerside wall and the involute starting point 202*d* of the inner side wall simultaneously without interfering in the starting end portion of the wrap as abovementioned. If it is desired to obtain for a scroll member whose involute angle $\gamma$ at the starting point 201*c* is greater by $\pi/3$ than that of a scroll member A the same built-in volume ratio $\eta$ as that for the scroll member A, it would be necessary to increase the terminating end of the wrap for the scroll member by $\pi/3\times\eta$ as compared with that of the scroll member A. Thus, it will be apparent that minimization of the starting end of the wrap enables the winding angle of the wrap and hence the outer diameter of the scroll member to be reduced. Further, in accordance with this scroll member, the flow of a fluid oriented toward the center port can be made smooth and minimizes a flow loss. Because the fluid begins to be exhausted when the end of one wrap is separated from the other wrap, the fluid is oriented toward the center port along the arcuate portions 202A and 212A as a turning flow.

What is claimed is:

1. A scroll member comprising an end plate, an upstranding wrap of a vortical form located on at least one surface of said end plate, said wrap having a thickness and a height, boundaries of the thickness of the wrap are defined by an outer side wall surface and an inner side wall surface thereof, the inner side wall surface of the wrap includes an arcuate starting end portion in the form of an arc of a circle of a predetermined radius, the radius of the arc is equal to a radius of a circle in contact with the outer side wall surface and the inner side wall surface of the wrap.

2. A scroll member as claimed in claim 1, wherein said arcuate starting portion of inner side wall surface of the wrap has an involute angle $\alpha$ within $\pi$ radians.

3. A scroll member as claimed in claim 2, wherein the involute angle $\alpha$ of said arcuate starting portion is equal to $\pi$ radians.

4. A scroll member as claimed in claim 1, wherein a portion of the inner side wall surface of the wrap except for said arcuate starting portion coincides with an involute of a circle and the outer side wall surface thereof coincides with the involute of the circle through the entire length thereof.

5. A scroll member as claimed in claim 4, wherein a port is located in one portion in the arcuate starting portion of the inner side wall surface of the wrap.

6. A scroll member as claimed in claim 1, wherein sid arcuate starting portion of the inner side wall surface of the wrap has an involute angle $\alpha$ equal to about 1.1 $\pi$ radians.

* * * * *